United States Patent [19]

Matsushita

[11] 3,934,342

[45] Jan. 27, 1976

[54] CARPET CUTTER

[76] Inventor: Katsumi Matsushita, No. 14-14, 1-cho Kaorigaoka, Sakai, Osaka, Japan

[22] Filed: Aug. 30, 1974

[21] Appl. No.: 501,866

[52] U.S. Cl. ..... 30/293
[51] Int. Cl.[2] ..... B26B 29/00
[58] Field of Search ..... 30/293, 287, 294, 289

[56] References Cited

UNITED STATES PATENTS

| | | | |
|---|---|---|---|
| 2,772,474 | 12/1956 | Hill et al. | 30/293 |
| 3,363,314 | 1/1968 | O'Brien | 30/293 X |
| 3,395,453 | 8/1968 | Prater | 30/293 |
| 3,535,786 | 10/1970 | Sanders | 30/293 |
| 3,546,726 | 12/1970 | Bizzigotti | 30/293 X |
| 3,581,397 | 6/1971 | Kochanowski | 30/293 |
| 3,737,932 | 6/1973 | Armijo | 30/293 |

*Primary Examiner*—Al Lawrence Smith
*Assistant Examiner*—J. T. Zatarga
*Attorney, Agent, or Firm*—George B. Oujevolk

[57] ABSTRACT

A carpet cutter for cutting a carpet at the time of spreading it in a room. The carpet cutter in this invention makes it possible to finish the carpet so as to just fit in the room precisely without causing any damage on the floor, wall and the like. This carpet cutter comprises a base plate, a grip for gripping the tool firmly in hand, a guide plate for enabling the tool to move straight along the wall in a carpet cutting movement, said guide plate at a side opposite to the wall facing side having a mechanism for firmly setting a blade therein, and a wheel member incorporated in said tool playing the role of pressing down the carpet at the vicinity of the cutting portion thereby, making it possible to adjust the length or width of the carpet so as to make it fit in a room where it is spread by predeterminedly adjusting the vertical position of said wheel member with the use of a graduation marked beside it.

3 Claims, 7 Drawing Figures

CARPET CUTTER

BACKGROUND OF THE INVENTION

The present invention relates to a carpet cutter and in particular a carpet cutter which can cut a carpet precisely without causing any damage to the side wall, floor and the like against which the carpet abuts.

BRIEF DESCRIPTION OF THE PROBLEM

When spreading a carpet in a room and the like, it is usual that a carpet a bit larger than the area of the carpeting place is used, the surplus portion being cut off from the carpet so as to make the carpet just fit in the room.

Conventionally carpets are cut to the above-described effect with the use of some kind of tool, either a tool made exclusively for that purpose or any kind of blade as a provisional tool, with the result more often than not that said tool causes a bruise or bruises on the floor or the wall against which the carpet abuts. Also, carpet cutting requires a highly experienced technique to cope with cutting conditions that may vary in accordance with the kind and thickness of the carpet. Furthermore, conventional carpet cutting costs additional time and labor for applying finishing touches on the cut surface of a carpet to make it fittingly contact with the wall and the like.

OBJECTS OF THE INVENTION

A first object of this invention is to provide a carpet cutter capable of cutting a carpet at the time of spreading it in a room so as to make the cut section just fit the wall and floor surface only by means of moving the cutter along the corner between the wall and the floor, a guide plate of said cutter keeping a pressure contact with the wall during the cutting trip of said cutter.

A second object of this invention is to provide a carpet cutter to cut a carpet in the above mentioned state without causing damage by the blade on the wall and floor surface by means of adjusting the blade at the rear portion of said guide plate.

(In the above and hereinafter, rear and front or back and forth are equivalent to right and left in FIG. 2.)

A third object of this invention is to provide a carpet cutter to carry out an accurate and flawless cutting of a carpet state by means of providing a wheel member which pressing down the carpet along the cutting portion thereby making it possible to adjust the carpet length as desired by previously adjusting said wheel member in the vertical position thereof.

A fourth object of this invention is to design a carpet cutter which can provide the best suitable cutting in accordance with the kind, thickness and spreading situation of the carpet by means of a mechanism to change the cutting angle as desired.

These objects can be accomplished by the improvement, combination and operation of every part constituting this invention, the preferred embodiment of which will be apparent in the attached drawings and the illustration herein given.

DETAILED DESCRIPTION

Figure 1:
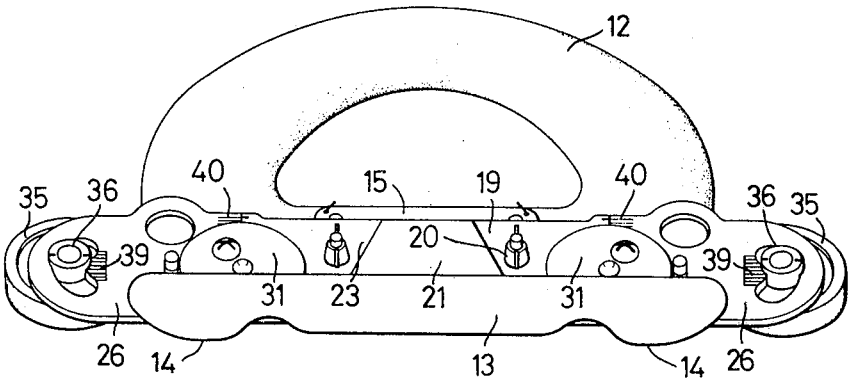
FIG. 1 is a front view showing an embodiment of this invention.
Figure 2:
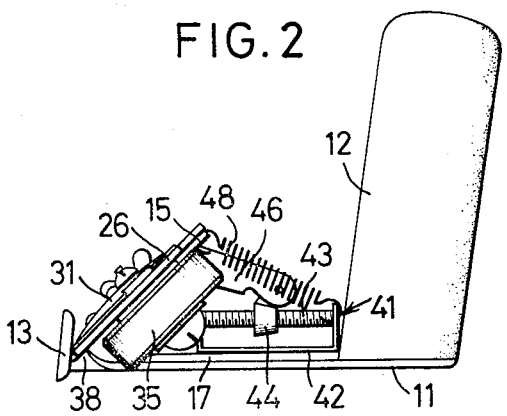
FIG. 2 is a side view of the invention.
Figure 3:
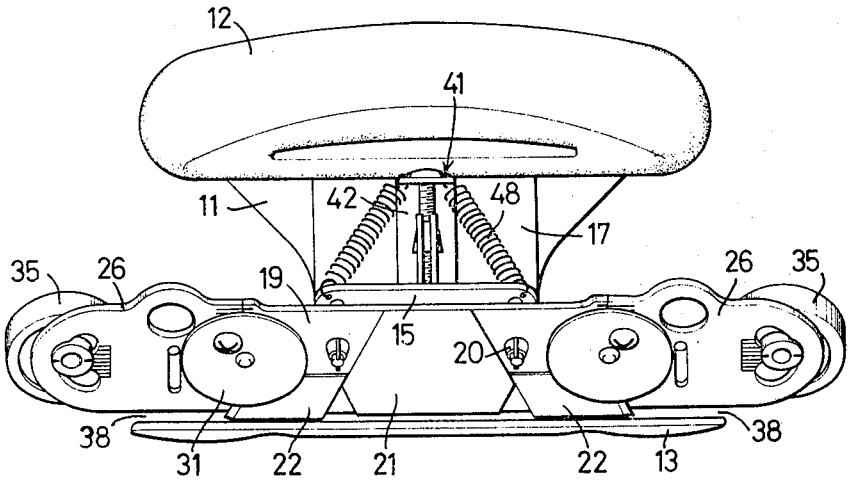
FIG. 3 is a plan view of the invention.
Figure 4:
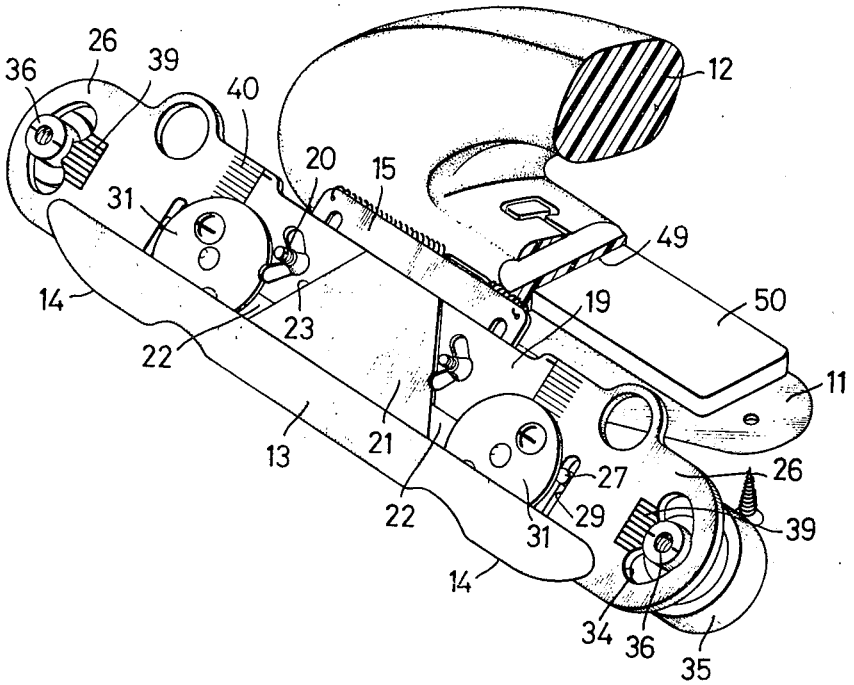
FIG. 4 is a partially broken perspective view of the invention.

In the drawing, numeral 11 designates a base plate enabling the carpet cutter to move slidably on a spread carpet, at the upper rear surface portion of base plate 11, there is a grip 12 available for holding the carpet cutter firmly in hand.

An elongated side guide plate is projects upwards slightly and is inclined backward at the front edge of base plate 11, the guide plate 13 abuts at the lower edge thereof against the corner between the wall and the floor, the guide plate 13 forming a semi-circle at the sidewise terminals thereof. Also the guide plate 13 at the lower edge thereof projects slightly from the lower face of the base plate 11 thereby forming a carpet pressing portion 14.

At the rear side of guide plate 13 on the upper face of the base plate 11 is mounted an oscillatable plate 15 at the lower portion thereof keeping a suitable distance between said edge and the guide plate 13. The oscillatable plate 15 at the lower terminal thereof connects to a fitting plate 17 via an axis 16 acting as a hinge, said fitting plate 17 through its overlapping portion fixed to the base plate 11 also fixes the plate 15 to said base plate 11, said oscillatable plate 15 having a slit 18 at both sides thereof.

A sideways extending blade holder 19 firmly but detachably holds the blade 22 at both terminal portions thereof, said blade holder 19 being in front of plate 15, said blade holder 19 measuring a bit shorter than the guide plate 13 and longer than the front width of base plate 11. Also blade holder 19 can be aligned side by side with the guide plate 13 overlapping at the central portion thereof over plate 15 and fixed thereto so as to be adjustable vertically as desired by means of a tightening member 20 which penetrates through said slit 18.

At the front central portion of the blade holder 19 is raised portion 21 by means of either embossing the holder 19 itself or lapping the other plate thereover, said raised portion 21 forming a downward widening shape but tapering downward intermediately at the lower portion thereof thereby giving the blade a trapezoidal formation to fit at one edge either to the downward widening edge 23 of the raised portion 21 or the downward tapering edge 24 of the same with the result that the blade is usable at both vertical edges thereof.

Figure 5:
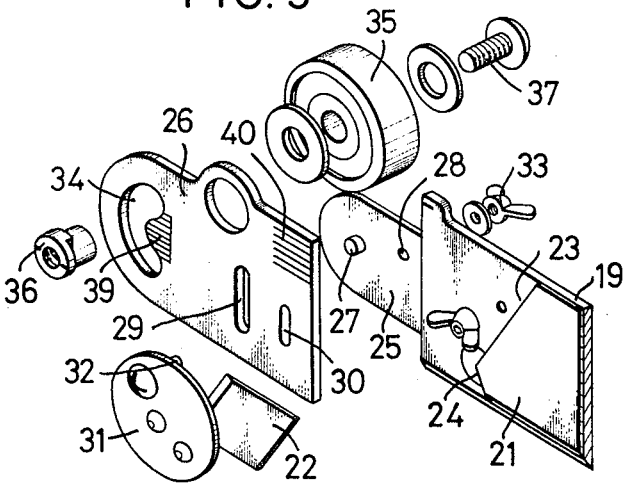
FIG. 5 is a perspective view of the invention at the blade adjusting portion thereof in a disassembled state.

The blade holder 19, as shown in FIG. 5, is provided at the rear side surface of both terminal portions with a wing member 25, said blade holder 19 also at the sidewise edge thereof connecting to a blade fitting plate 26, said blade fitting plate 26 partially lapping over the rear side wing member 25 which forms a forward projection 27 thereon and a penetration hole 28 penetrating back and forth therethrough, said blade fitting plate 26 abutting at the terminal edge thereof against the blade holder 19, said blade fitting plate 26 having a vertical slit 29 through which projection 27 penetrates and another vertical slit 30 communicating with said penetration hole 28 thereby enabling blade fitting plate 26 to be vertically adjusted as desired relative to said blade holder 19.

In front of blade fitting plate 26 is mounted a disk-like blade guard 31, said blade guard 31 having a screw 32 which projects rearward thereby penetrating through slit 30 and penetration hole 28 until projecting out of the wing member 25 rearward, said blade guard 31 thereby firmly holding the blade fitting plate 26 in the state of sandwiching it in cooperation with the wing member 25 by means of tightening a nut 33 spirally equipped on said screw 32.

Also blade guard 31 at the portion thereof overlapping blade holder 19 securely holds the blade 22 by means of sandwiching the blade 22 which also overlaps the blade holder 19.

The blade fitting plate 26 extends outwards past the wing member 25 and forms at the terminal portion in the extending direction thereof, an arcuate vertical slit 34, said blade fitting plate 26 at the rear face thereof being axially provided with a wheel member 35 for pressing down a carpet in the process of the carpet cutting operation, said wheel member 35 being vertically adjustable along the slit 34.

The wheel member 35 is installed by means of inserting a spiral tube 36 into said slit 34 so as not to go therethrough from the front of the blade fitting plate 26, thence screwing the screw 37 at the forward tip thereof into spiral tube 36 from the rear side of blade fitting plate 26, said screw 37 having penetrated into wheel member 35, the wheel member 35 is adjustable of its vertical position under the adjustment of the screw 37 within the scope of said slit 34.

Between the guide plate 13 at the rear side terminal portion and the blade fitting plate 26 at its lower edge is a space 38 for allowing the carpet A to enter therein. The tip of blade 22 projects into said space 38.

Graduations 39 are marked along the edge of slit 34 so as to adjust the wheel member 35 at its vertical position so that the wheel member 35 is at the proper position for the length of the carpet A when it is spread in a room after completion of the cutting. The other graduation 40 is provided on the blade fitting plate 26 at the edge so that the plate 26 makes a side contact with the blade holder 19, the position of blade fitting plate 26 is vertically adjustable according to the graduation 40 thereby enabling the space 38 to widen in accordance with thickness of the carpet A.

An adjusting mechanism 41 is arranged at the rear portion of oscillating plate 15, said adjusting mechanism 41 serving to adjust the rising angle of plate 15.

Figure 6:
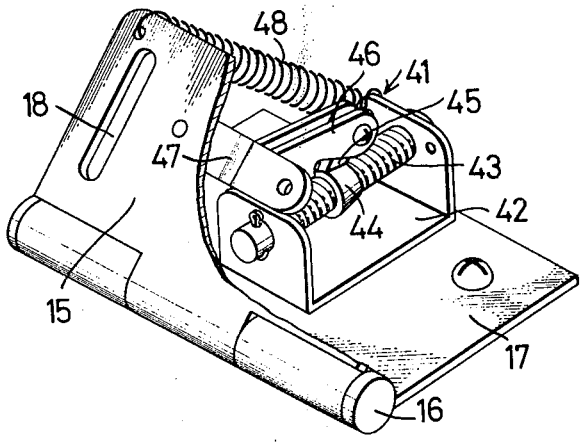
FIG. 6 is a partially broken perspective view of the invention at the portion of adjusting the blade angle thereof.
Figure 7:
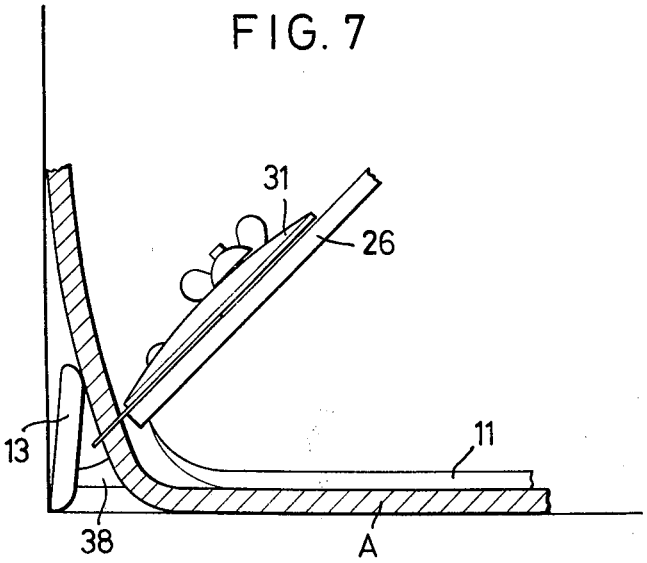
FIG. 7 is a side view showing the main parts of this invention in the state of cutting the carpet.

This adjusting mechanism 41, as shown in detail in FIG. 6, comprises a bearing member 42 which fixing to the fitting plate 17 at the upper face central portion thereof in the state of lapping thereover, said bearing member 42 comprises vertical walls mounted in a rear and front confrontation with each other, said vertical walls rotatably holding a spiral shaft 43 over which is a cylindrical member 44, said cylindrical member 44 having at the upper portion of the outer periphery thereof a projecting piece 45, said projecting piece 45 at the upper terminal thereof axially connecting to a link 46 at the base portion thereof, said link 46 at the forward tip thereof axially linking to a fitting metal part 47 which is fixed to the rear face of the oscillating plate 15, further a spring 48 is provided in between plate 15 at the upper edge thereof and the rear side wall of said bearing member 42.

The spiral shaft 43 is to be driven rotationally at its rear side terminal projecting out of the rear side wall of bearing member 42 with a driver so that the spiral shaft 43 with its rotating movement back and forth can move the cylindrical member 44 back and forth resulting in the change of rising angle of oscillating plate 15 via the link 46.

Accordingly, the blade 22 connected to plate 15 via the blade holder 19 can change its rising angle as required, this angle adjustment is necessary for the sake of changing the angle of the carpet's cut section relative to the wall or the floor.

The spiral shaft 43 can also be equipped with a kind of thumb nut and the like for its operation directly by fingers instead of using a driver.

The grip 12 and the base plate 11 at their contacting portion form a hollow chamber 49 for encasing a blade container 50 therein, said chamber 49 opening backward so that the blade container 50 can come in and out of said chamber 49 therethrough.

OPERATION OF THE INVENTION

The blade 22 is set at first at both terminals of the blade holder 19 with the disk-like blade guard 31 applying a pressure contact thereto, thereby adjusting the blade rising angle as predetermined by plate 15 under the operation of the adjusting mechanism 41.

Then the blade holder 19 is fixed to plate 15 so as to have the blade holder 19 at the lower edge thereof make a contact with the base plate 11, thereby adjusting the vertical position of the blade fitting plate 26 and the wheel member 35 in accordance with the length and thickness of the cutting carpet.

The carpet A when spread in a room has surplus edge portions which rise along the floor and upward along the wall face.

The carpet cutter after completion of the foregoing adjustment is placed on the carpet in such a manner that the guide plate 13 of the carpet cutter abuts against the wall thereby inserting the carpet at the terminal portion rising from the bending part upward along the wall into the space 38 between guide plate 13 and blade fitting plate 26.

At this time, the wheel 35 is playing the role of holding down the carpet A at its terminal portion within the scope of the spread carpet over the room floor.

In the above state, the carpet cutter at the blade 22 thereof cuts the carpet A as it moves along the carpet bending corner with the guide plate 13 keeping a pressure contact with the wall.

The edge of the carpet spread over the room is guided so as to enter smoothly beneath the base plate 11 at the forward tip thereof after completion of the cutting, so that the carpet A at the cut section makes a close contact with the floor or the wall face. At this time, the pressing portion 14 which is cornered between the guide plate 13 and the base plate 11 keeps pressing down the carpet A at the cut portion thereof throughout the cutting process thereby making it possible to carry out a complete spreading of the carpet A in a single operation of the cutting process.

As apparent in the foregoing illustration, the present invention makes it possible to cut a carpet so as to make it fit in where it is to be spread in a single operation without causing any damage on the wall, floor and the like also does not require experience or technique for the carpet cutting.

What is claimed is:

1. A carpet cutter, comprising in combination:

a. a horizontal base plate (11) with one and another terminal portions, said base plate being slidable along a carpet;

b. a grip (12) vertically mounted along said one terminal portion of said base plate;

c. a sidewise extending guide plate (13) disposed vertically at substantially a right angle to said base plate (11) at said other terminal portion, said guide plate (13) being substantially parallel to said grip (12), one side of said guide plate facing said grip (12), said guide plate (13) being longer than and extending outwardly from the base plate (11) at both sides thereof;

d. an oscillatable plate (15) with a lower terminal axially connected to said base plate (11) at the immediate vicinity of said guide plate (13) on said grip facing side;

e. a blade holding plate (19) with a terminal section fixed to said oscillatable plate (15) at said side facing the guide plate (13), a blade fitting plate (20) connected sidewise to said terminal section, said blade fitting plate (20) holding a blade (22) with a cutting portion to the blade holding plate (19) at said terminal section in the position of having the blade (22) overlapping, a space (38) for allowing the insertion of a carpet defined between the guide plate (13) on the grip facing side and the blade cutting portion;

f. a wheel member (35) disposed on said blade fitting plate (20) outwards of the blade cutting portion at the grip facing side thereof, said wheel member (35) serving to press the carpet at the cutting portion thereof by rolling thereover while cutting the carpet; and, g. a rotatable spiral shaft (43) and a spiral cylinder (44) with a link (46) disposed between the oscillatable plate (15) and the grip (12) on said base plate (11), said oscillatable plate (15) being connected to said spiral cylinder (44) by said link (46) so that the angle of said oscillatable plate (15) to said base plate (11) is adjustable.

2. A carpet cutter as claimed in claim 1, said wheel member (35) being vertically adjustable as desired in accordance with the thickness of the carpet.

3. A carpet cutter as claimed in claim 1 in which the blade fitting plate is vertically adjustable and has graduations thereon so as to adjust said space (38) in accordance with the thickness of the carpet inserted therein.

* * * * *